US007174588B1

(12) United States Patent
Chen

(10) Patent No.: US 7,174,588 B1
(45) Date of Patent: Feb. 13, 2007

(54) MEDICAL CHAIR HAVING SYNCHRONOUSLY ADJUSTING FUNCTION

(76) Inventor: Li-Chieh Chen, 95, Lane 100, San Jiao Alley, Shiu Mei Vill, Wai Pu, Taichung Hsien (TW)

( * ) Notice: Subject to any disclaimer, the term of this patent is extended or adjusted under 35 U.S.C. 154(b) by 0 days.

(21) Appl. No.: 11/008,551

(22) Filed: Dec. 9, 2004

(51) Int. Cl.
*A61G 7/015* (2006.01)

(52) U.S. Cl. ..... 5/618

(58) Field of Classification Search ..... 5/613, 5/614, 616, 617, 618
See application file for complete search history.

(56) References Cited

U.S. PATENT DOCUMENTS

| | | | | | |
|---|---|---|---|---|---|
| 791,295 | A * | 5/1905 | Sennett | 5/618 |
| 1,397,041 | A * | 11/1921 | Dodds | 5/618 |
| 2,336,850 | A * | 12/1943 | Davis | 5/618 |
| 2,349,701 | A * | 5/1944 | Buttikofer | 5/616 |
| 2,500,742 | A * | 3/1950 | Taylor | 5/616 |
| 2,617,118 | A * | 11/1952 | Lorenz | 5/618 |
| 3,216,026 | A * | 11/1965 | Mann | 5/616 |
| 3,644,945 | A * | 2/1972 | Goodman et al. | 5/616 |
| 4,227,269 | A * | 10/1980 | Johnston | 5/611 |
| 4,821,351 | A * | 4/1989 | Bergenwall | 5/618 |
| 5,105,486 | A * | 4/1992 | Peterson | 5/611 |
| 5,160,010 | A * | 11/1992 | Peterson | 5/613 |
| 5,868,461 | A * | 2/1999 | Brotherston | 297/84 |
| 6,000,077 | A * | 12/1999 | Cyr | 5/618 |
| 6,006,379 | A * | 12/1999 | Hensley | 5/618 |
| 6,393,641 | B1 * | 5/2002 | Hensley | 5/618 |
| 6,499,162 | B1 * | 12/2002 | Lu | 5/618 |
| 6,640,365 | B1 * | 11/2003 | Chang | 5/618 |
| 6,742,206 | B1 * | 6/2004 | Han | 5/618 |
| 6,792,633 | B1 * | 9/2004 | Ito | 5/618 |
| 6,826,793 | B2 * | 12/2004 | Tekulve | 5/618 |
| 6,951,037 | B2 * | 10/2005 | Weinman et al. | 5/618 |
| 6,974,186 | B1 * | 12/2005 | Chang | 297/68 |

* cited by examiner

*Primary Examiner*—Patricia Engle
*Assistant Examiner*—Jonathan Liu
(74) *Attorney, Agent, or Firm*—Alan D. Kamrath; Nikolai & Mersereau, P.A.

(57) ABSTRACT

A medical chair includes a main frame, an adjusting assembly pivotally mounted on the main frame, and a driving member pivotally mounted on the main frame and connected to the adjusting assembly to move the adjusting assembly. Thus, the first connecting member, the second connecting member and the third connecting member are moved by the adjusting assembly to move the head cushion, the seat cushion and the leg cushion, so that the head cushion, the seat cushion and the leg cushion are moved synchronously by operation of the adjusting assembly, thereby facilitating a user adjusting the state of the medical chair.

10 Claims, 5 Drawing Sheets

MEDICAL CHAIR HAVING SYNCHRONOUSLY ADJUSTING FUNCTION

BACKGROUND OF THE INVENTION

1. Field of the Invention

The present invention relates to a medical chair, and more particularly to a medical chair having a synchronously adjusting function.

2. Description of the Related Art

A conventional medical chair in accordance with the prior art shown in FIG. 5 comprises a main frame A, a head cushion B adjustably mounted on the main frame A by a first adjusting member E, a seat cushion C adjustably mounted on the main frame A by a second adjusting member F, and a leg cushion D adjustably mounted on the main frame A by a third adjusting member G. However, the head cushion B, the seat cushion C and the leg cushion D are adjusted independently by the first adjusting member E, the second adjusting member F and the third adjusting member G respectively, thereby causing inconvenience to a user in adjustment of the conventional medical chair.

SUMMARY OF THE INVENTION

In accordance with the present invention, there is provided a medical chair, comprising: a main frame; an adjusting assembly pivotally mounted on the main frame; a first connecting member pivotally mounted on the main frame and having a first section connected to and moved by the adjusting assembly; a second connecting member pivotally mounted on the main frame and having a first section connected to and moved by the adjusting assembly; and a third connecting member pivotally mounted on the main frame and having a first section connected to and moved by the adjusting assembly.

The primary objective of the present invention is to provide a medical chair having a synchronously adjusting function.

Another objective of the present invention is to provide a medical chair, wherein the first connecting member, the second connecting member and the third connecting member are moved by the adjusting assembly to move the head cushion, the seat cushion and the leg cushion, so that the head cushion, the seat cushion and the leg cushion are moved synchronously.

A further objective of the present invention is to provide a medical chair, wherein the head cushion, the seat cushion and the leg cushion are moved synchronously by operation of the adjusting assembly, so that the medical chair is adjusted easily and conveniently, thereby facilitating a user adjusting the state of the medical chair.

A further objective of the present invention is to provide a medical chair, wherein the head cushion, the seat cushion and the leg cushion are moved synchronously, so that the medical chair is expanded and folded rapidly, thereby facilitating the user operating the medical chair.

Further benefits and advantages of the present invention will become apparent after a careful reading of the detailed description with appropriate reference to the accompanying drawings.

DETAILED DESCRIPTION OF THE INVENTION

Figure 1:
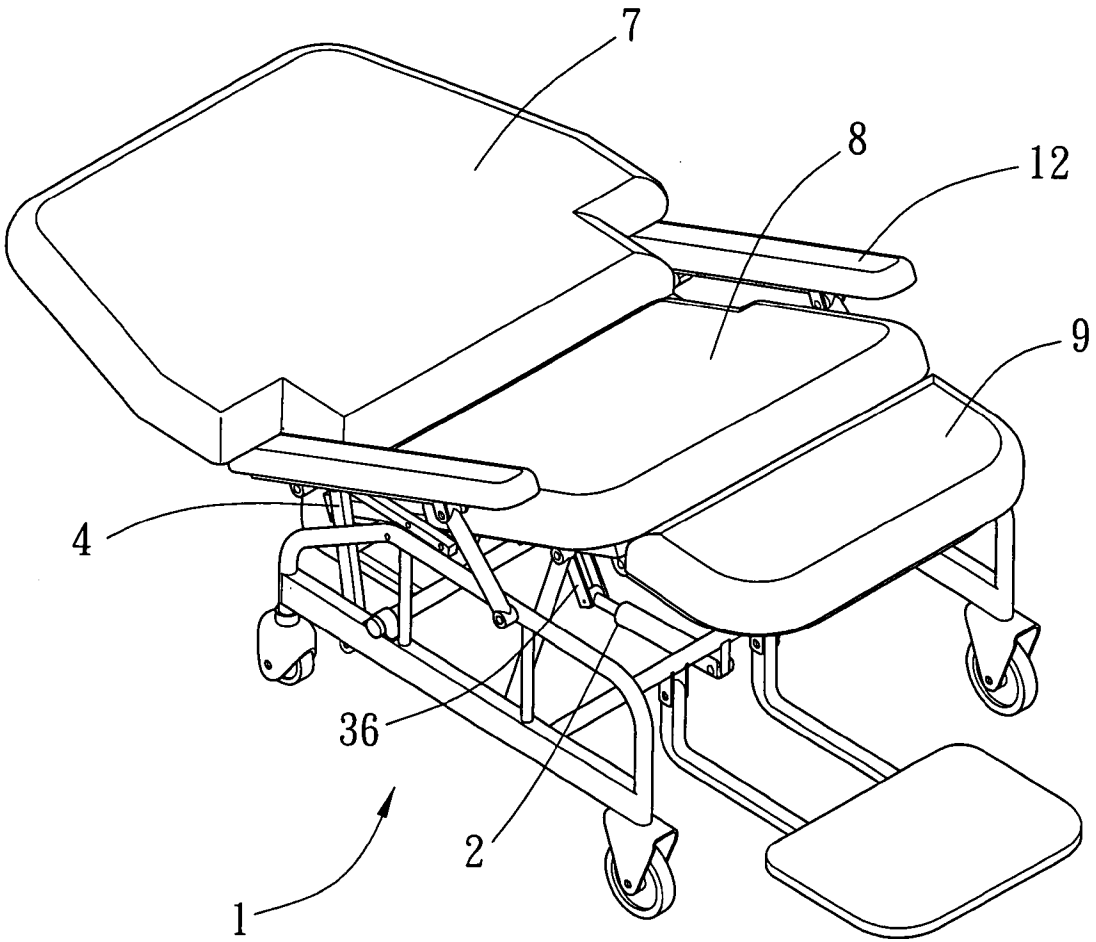
FIG. 1 is a perspective view of a medical chair in accordance with the preferred embodiment of the present invention.
Figure 2:
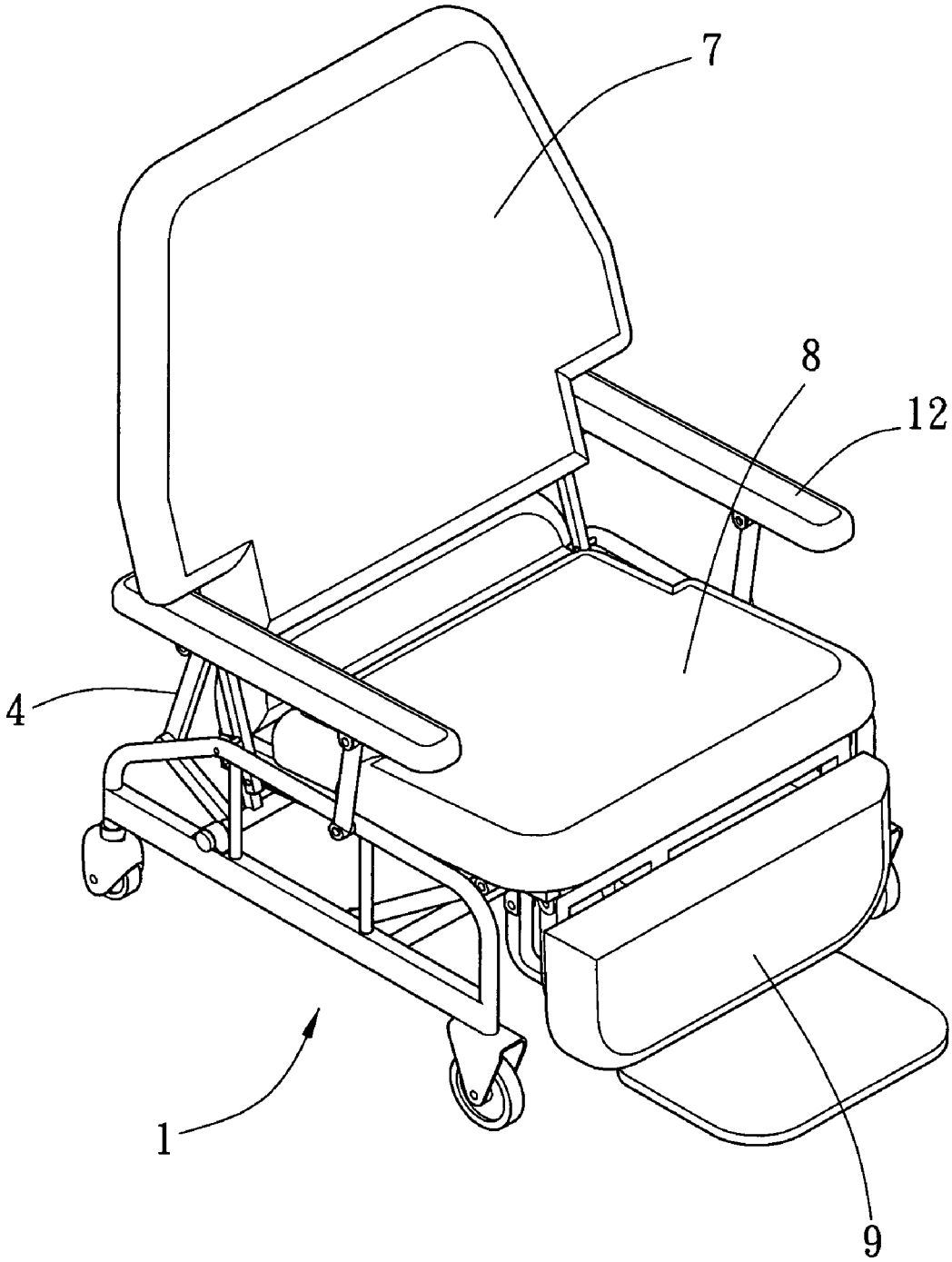
FIG. 2 is a schematic operational view of the medical chair as shown in FIG. 1.
Figure 3:
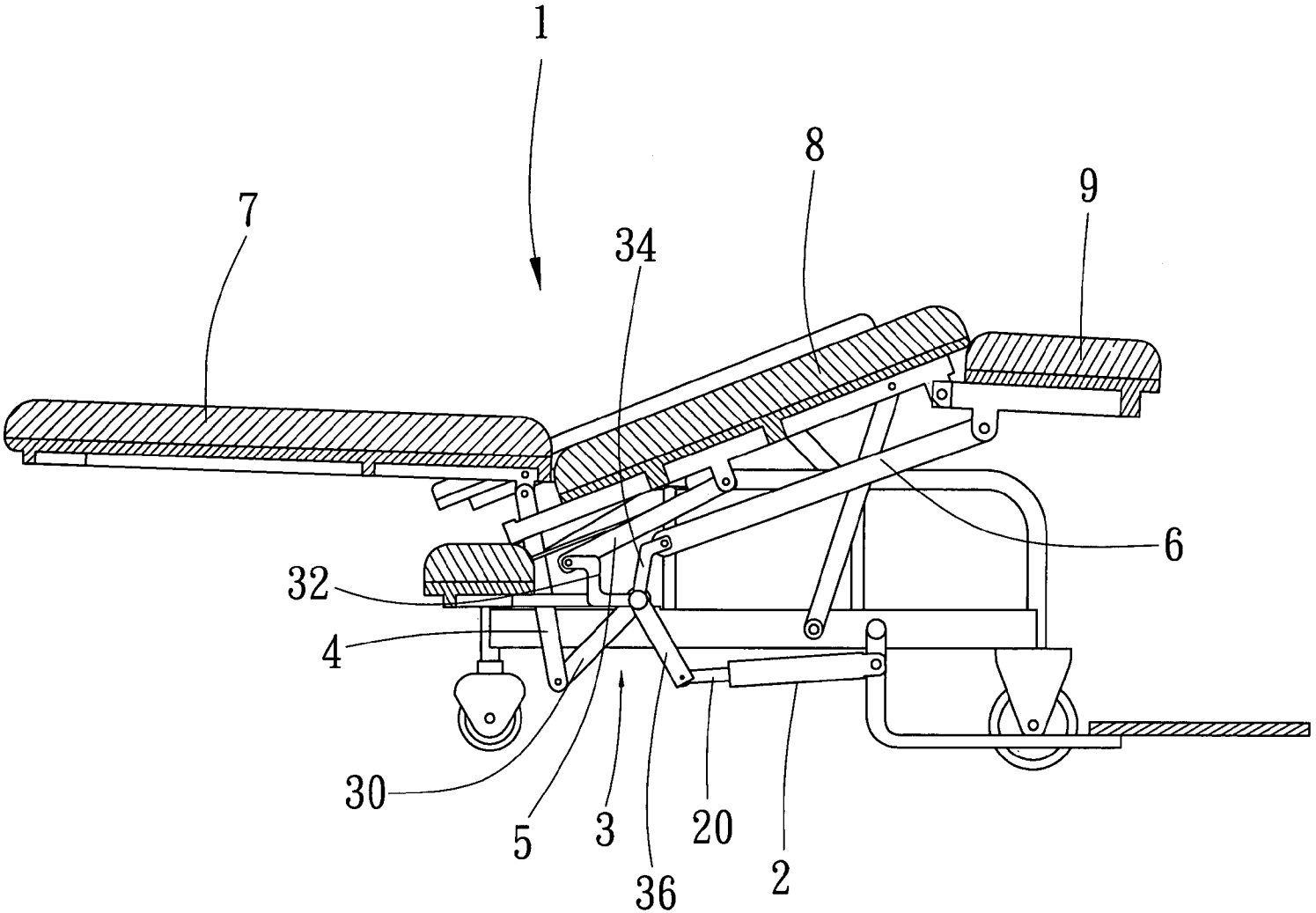
FIG. 3 is a side plan cross-sectional view of the medical chair as shown in FIG. 1.

Referring to the drawings and initially to FIGS. 1–3, a medical chair in accordance with the preferred embodiment of the present invention comprises a main frame 1, an adjusting assembly 3 pivotally mounted on the main frame 1, a telescopic driving member 2 pivotally mounted on the main frame 1 and connected to the adjusting assembly 3 to move the adjusting assembly 3, a first connecting member 4 pivotally mounted on the main frame 1 and having a first section connected to and moved by the adjusting assembly 3, a head cushion 7 mounted on a second section of the first connecting member 4 to move therewith, a second connecting member 5 pivotally mounted on the main frame 1 and having a first section connected to and moved by the adjusting assembly 3, a seat cushion 8 mounted on a second section of the second connecting member 5 to move therewith, a third connecting member 6 pivotally mounted on the main frame 1 and having a first section connected to and moved by the adjusting assembly 3, and a leg cushion 9 mounted on a second section of the third connecting member 6 to move therewith.

Thus, when the adjusting assembly 3 is moved by the driving member 2, the first connecting member 4, the second connecting member 5 and the third connecting member 6 are moved by the adjusting assembly 3 to move the head cushion 7, the seat cushion 8 and the leg cushion 9, so that the head cushion 7, the seat cushion 8 and the leg cushion 9 are moved synchronously.

The driving member 2 is a telescopic cylinder 2 mounted on a bottom of the main frame 1 and having a first end provided with a retractable driving lever 20 pivotally connected to the adjusting assembly 3 and a second end pivotally mounted on the main frame 1.

The adjusting assembly 3 includes a first adjusting lever 30 pivotally connected to the first section of the first connecting member 4, a second adjusting lever 32 pivotally connected to the first section of the second connecting member 5, a third adjusting lever 34 pivotally connected to the first section of the third connecting member 6, and a driven lever 36 pivotally connected to the driving lever 20 of the driving member 2.

As shown in FIGS. 1 and 2, the seat cushion 8 is pivotally provided with two armrests 12.

Figure 4:
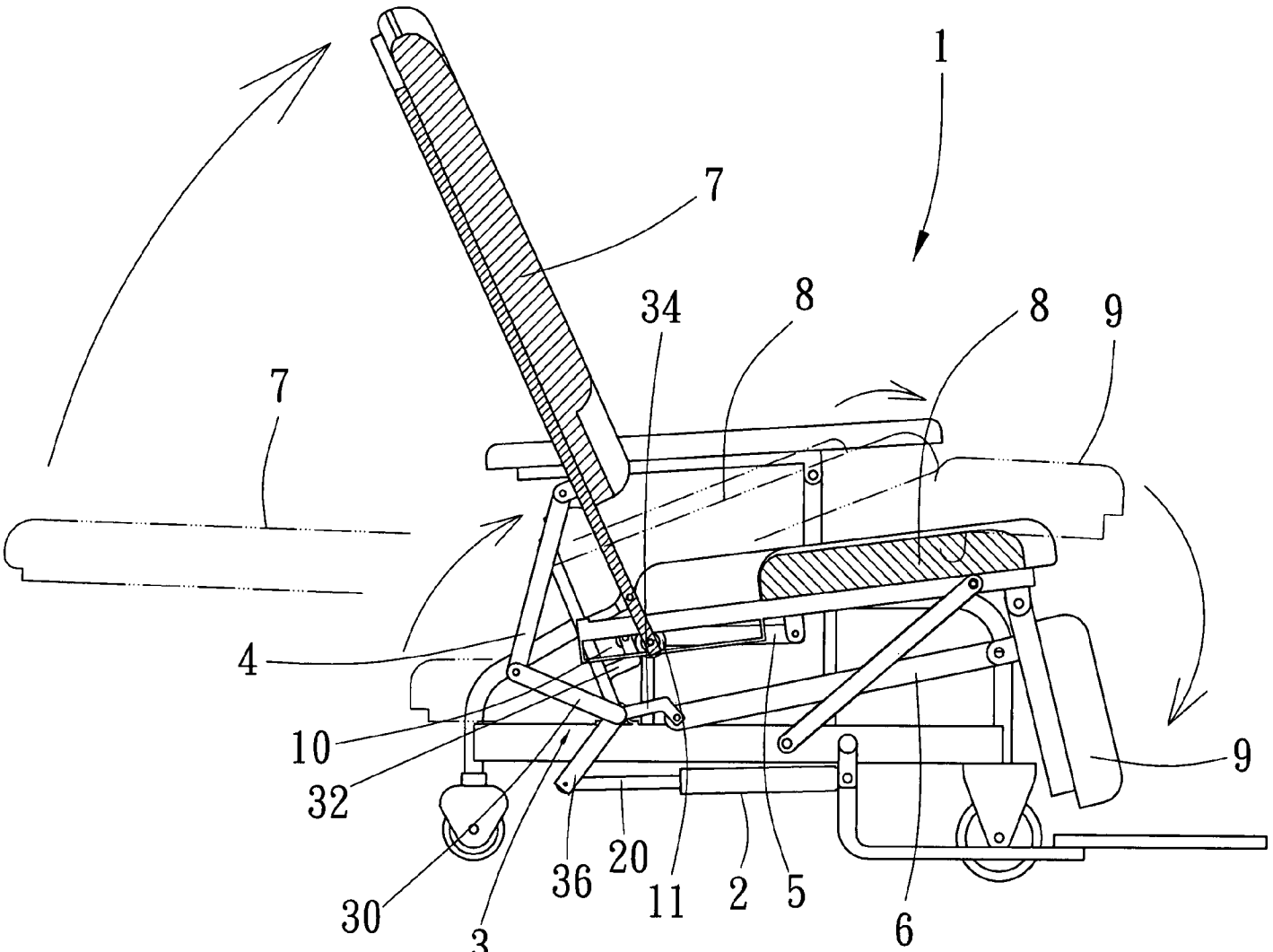
FIG. 4 is a side plan cross-sectional operational view of the medical chair as shown in FIG. 2.
Figure 5:
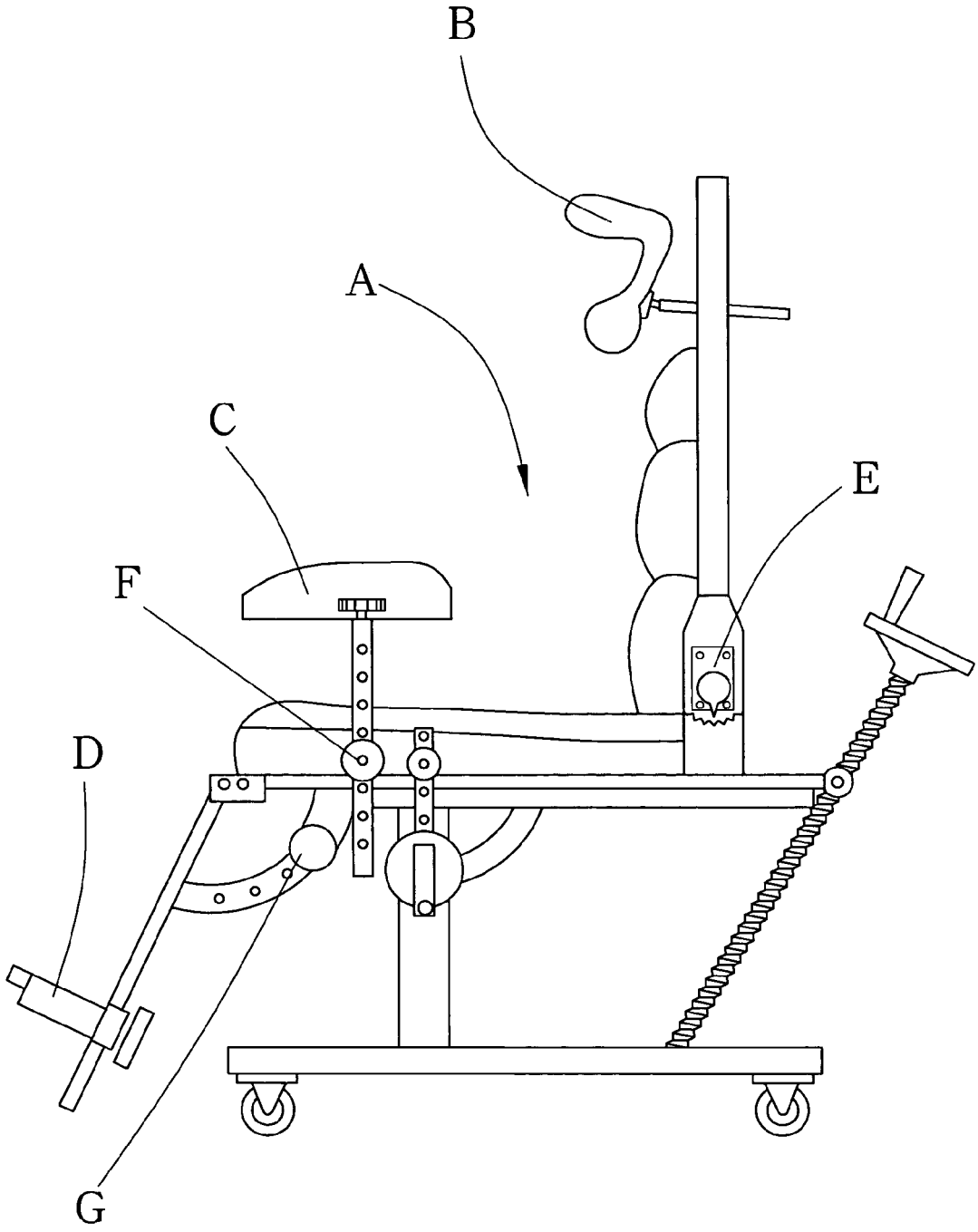
FIG. 5 PRIOR ART
FIG. 5 is a side plan cross-sectional view of a conventional medical chair in accordance with the prior art.

As shown in FIG. 4, the seat cushion 8 has a bottom having two sides each provided with a track 10, and a roller 11 movably mounted on the track 10, so that the seat cushion 8 is moved by guidance of the roller 11 and the track 10.

In operation, referring to FIGS. 1–4, when the driving member 2 is disposed at a retracted state, the head cushion 7, the seat cushion 8 and the leg cushion 9 are moved synchronously to reach a position as shown in FIGS. 1 and 3 where the head cushion 7, the seat cushion 8 and the leg cushion 9 are disposed at a substantially horizontal state. At this time, the two armrests 12 are pivoted with the seat cushion 8 and disposed at a substantially horizontal lying state.

Alternatively, when the driving member 2 is disposed at an expanded state, the head cushion 7, the seat cushion 8 and the leg cushion 9 are moved synchronously to reach a position as shown in FIGS. 2 and 4 where the first connecting member 4 is driven by the adjusting assembly 3 to move upward and forward, the second connecting member 5 is driven by the adjusting assembly 3 to move downward and forward, and the third connecting member 6 is driven by the adjusting assembly 3 to move downward and rearward, so that the head cushion 7 is moved upward, the seat cushion 8 is moved forward and the leg cushion 9 is moved downward, thereby forming a substantially upright standing state.

Accordingly, the first connecting member 4, the second connecting member 5 and the third connecting member 6 are moved by the adjusting assembly 3 to move the head cushion 7, the seat cushion 8 and the leg cushion 9, so that the head cushion 7, the seat cushion 8 and the leg cushion 9 are moved synchronously. In addition, the head cushion 7, the seat cushion 8 and the leg cushion 9 are moved synchronously by operation of the adjusting assembly 3, so that the medical chair is adjusted easily and conveniently, thereby facilitating a user adjusting the state of the medical chair. Further, the head cushion 7, the seat cushion 8 and the leg cushion 9 are moved synchronously, so that the medical chair is expanded and folded rapidly, thereby facilitating the user operating the medical chair.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the true scope of the invention.

What is claimed is:

1. A medical chair, comprising:

a main frame;

an adjusting assembly pivotally mounted on the main frame;

a first connecting member pivotally mounted on the main frame and having a first section connected to and moved by the adjusting assembly so that the first connecting member is pivoted and moved by the adjusting assembly;

a second connecting member pivotally mounted on the main frame and having a first section connected to and moved by the adjusting assembly so that the second connecting member is pivoted and moved by the adjusting assembly;

a third connecting member pivotally mounted on the main frame and having a first section connected to and moved by the adjusting assembly so that the third connecting member is pivoted and moved by the adjusting assembly;

a telescopic driving member pivotally mounted on the main frame and pivotally connected to the adjusting assembly to move and pivot the adjusting assembly directly so as to move and pivot the first connecting member, the second connecting member and the third connecting member.

2. The medical chair in accordance with claim 1, wherein the adjusting assembly includes a first adjusting lever pivotally connected to the first section of the first connecting member, a second adjusting lever pivotally connected to the first section of the second connecting member, and a third adjusting lever pivotally connected to the first section of the third connecting member.

3. The medical chair in accordance with claim 1, wherein the driving member is a telescopic cylinder mounted on a bottom of the main frame.

4. The medical chair in accordance with claim 1, wherein the driving member is a telescopic cylinder having a first end provided with a retractable driving lever pivotally connected to the adjusting assembly directly and a second end pivotally mounted on the main frame.

5. The medical chair in accordance with claim 4, wherein the adjusting assembly includes a driven lever pivotally connected to the driving lever of the driving member directly.

6. The medical chair in accordance with claim 1, wherein the first connecting member, the second connecting member and the third connecting member are moved synchronously by the adjusting assembly.

7. A medical chair, comprising:

a main frame;

an adjusting assembly pivotally mounted on the main frame;

a first connecting member pivotally mounted on the main frame and having a first section connected to and moved by the adjusting assembly so that the first connecting member is pivoted and moved by the adjusting assembly;

a second connecting member pivotally mounted on the main frame and having a first section connected to and moved by the adjusting assembly so that the second connecting member is pivoted and moved by the adjusting assembly;

a third connecting member pivotally mounted on the main frame and having a first section connected to and moved by the adjusting assembly so that the third connecting member is pivoted and moved by the adjusting assembly;

a head cushion pivotally mounted on a second section of the first connecting member to move therewith so that the head cushion is pivoted and moved by the first connecting member, a seat cushion pivotally mounted on a second section of the second connecting member to move therewith so that the seat cushion is pivoted and moved by the second connecting member, and a leg cushion pivotally mounted on a second section of the third connecting member to move therewith so that the leg cushion is pivoted and moved by the third connecting member;

wherein the seat cushion has a bottom having two sides each provided with a track and a roller movably mounted on the track, so that the seat cushion is moved by guidance of the roller and the track.

8. The medical chair in accordance with claim 7, wherein the first connecting member, the second connecting member and the third connecting member are moved and pivoted synchronously by the adjusting assembly to move the head cushion, the seat cushion and the leg cushion, so that the head cushion, the seat cushion and the leg cushion are moved synchronously.

9. The medical chair in accordance with claim 7, wherein the seat cushion is pivotally provided with two armrests which are pivoted with the seat cushion.

10. The medical chair in accordance with claim 7, wherein the leg cushion is pivotally connected with the seat cushion so that the leg cushion is pivoted in concert with the seat cushion.

* * * * *